US005154234A

United States Patent [19]

Carrico

[11] Patent Number: 5,154,234

[45] Date of Patent: Oct. 13, 1992

[54] WELLHEAD FIRE EXTINGUISHER AND METHOD EXTINGUISHING A WELL FIRE

[76] Inventor: Paul B. Carrico, 1980 Porters Chapel Rd., Vicksburg, Miss. 39180

[21] Appl. No.: 769,793

[22] Filed: Oct. 2, 1991

[51] Int. Cl.[5] ..... A62C 3/06

[52] U.S. Cl. ..... 169/46; 169/47; 169/48; 169/52; 169/69

[58] Field of Search ..... 169/69, 43, 46, 47, 169/48, 49, 52

[56] References Cited

U.S. PATENT DOCUMENTS

| | | | |
|---|---|---|---|
| 1,520,288 | 12/1924 | Featherstone | 169/69 X |
| 1,807,498 | 5/1931 | Teed | 169/69 X |
| 1,857,788 | 5/1932 | Murphy | 169/69 X |
| 1,859,606 | 5/1932 | Sievern et al. | 169/69 X |
| 1,921,739 | 8/1933 | Fleischmann | 169/69 |
| 3,887,011 | 6/1975 | Dokes et al. | 169/69 |
| 4,323,118 | 4/1982 | Bergmann | 169/69 X |
| 4,337,831 | 7/1982 | Thaxton | 169/69 |

*Primary Examiner*—Margaret A. Focarino
*Assistant Examiner*—Andrew C. Pike
*Attorney, Agent, or Firm*—Wigman & Cohen

[57] ABSTRACT

A wellhead fire extinguishing apparatus comprises a flame containment housing which is lowered into place above the wellhead fire to create a chimney-like updraft and draw the fire surrounding the wellhead into the housing. The housing is then lowered to the well platform or ground and the flame is cooled by a coolant/-flame retardant to cause the ignition point of the flame to rise above a flapper valve in the housing. The flapper valve is closed by remote actuation to separate the flame from the fuel flowing from the wellhead. The unburned fuel is vented from the housing and the flame is extinguished by the coolant/flame retardant.

20 Claims, 2 Drawing Sheets

FIG. 3
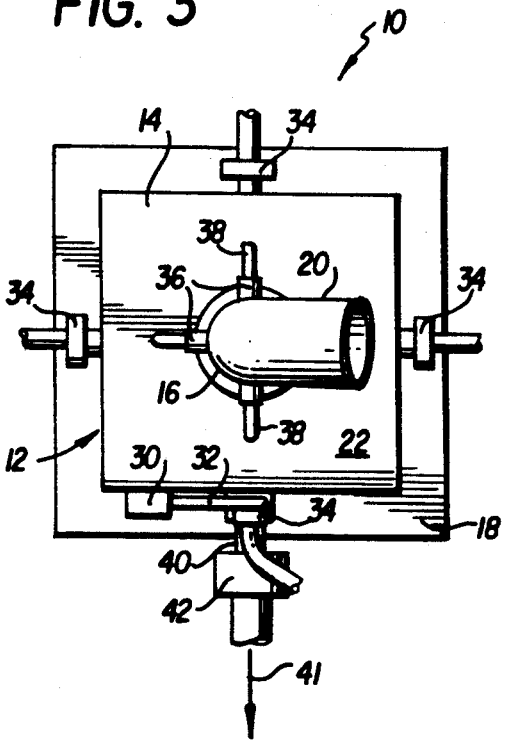
FIG. 4
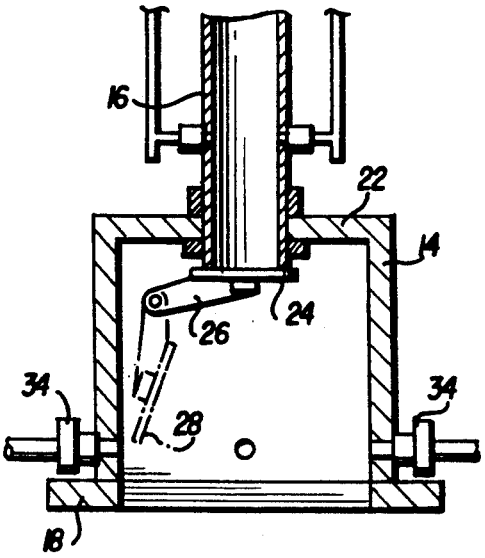
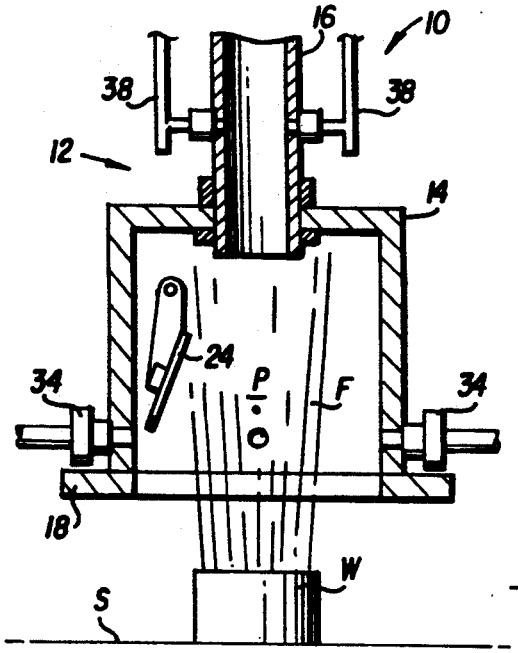
FIG. 5
FIG. 6
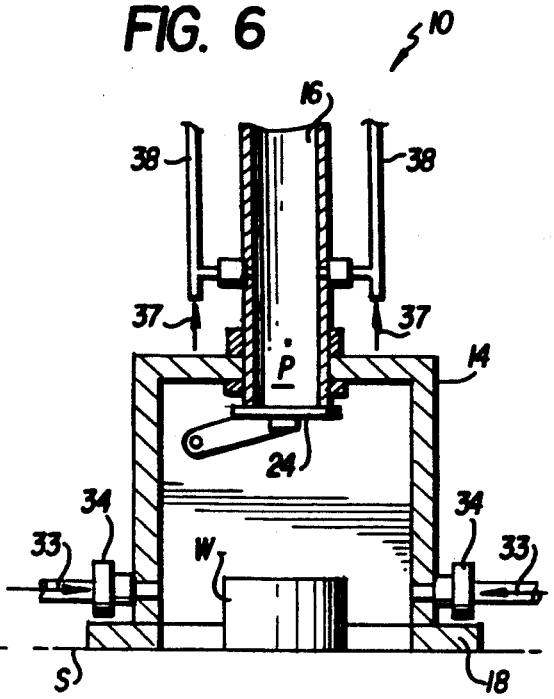

WELLHEAD FIRE EXTINGUISHER AND METHOD EXTINGUISHING A WELL FIRE

FILED OF THE INVENTION

The present invention relates to fire extinguishing apparatus and methods, and more particularly to an apparatus for and a method of extinguishing fires at the wellhead of a well, such as an oil or gas well.

DESCRIPTION OF THE PRIOR ART

The art of extinguishing oil and gas well fires has become highly developed over the years, but there are still relatively few apparatus and methods that are used with success. One known technique for extinguishing oil well fires involves detonating an explosive device directly above the wellhead to consume all the oxygen supporting combustion of the wellhead fire.

It has also been proposed to equip an oil well with an in-situ fire extinguishing apparatus which may be remotely activated or automatically activated by temperature sensitive devices at the wellhead. U.S. Pat. Nos. 3,887,011 to Dokes et al. and 4,337,831 to Thaxton are examples of such prior art apparatus. The Dokes et al. apparatus is temperature activated by a fusible link which, when melted, operates a valve arrangement to smother the fire and bypass the oil to an isolated exhaust pipe. The Thaxton apparatus employs an apparatus mounted on the well platform which comprises a plurality of tanks of fire extinguishing material and a valving system adapted to be manually activated to cause the fire extinguishing material to flow into the wellhead.

U.S. Pat. Nos. 1,520,288 to Featherstone and 1,857,788 to Murphy disclose oil well fire extinguishing apparatus that are transported to an oil well fire and are lowered or dropped into place over the fire so that fire extinguishing material can be injected into a housing surrounding the fire to extinguish the same. The Featherstone device comprises a cone-shaped body with a double-walled reservoir containing a fire extinguishing chemical. The body is placed over the wellhead with a boom and cables and two valved outlets relieve the pressure generated by the burning oil. A pressurized fluid is applied to the reservoir to blow out soft plugs in the interior reservoir wall and discharge the fire extinguishing material into the interior of the body. The Murphy apparatus is a large, complex and heavy structure that is brought into position adjacent an oil well fire on several tracks laid for the purpose. When in place, the Murphy apparatus is tilted over onto the wellhead to force a plug of water upwardly through a conical aperture to break the flow of combustible material from the well. If the fire is not extinguished by that step, a valving arrangement may be operated to isolate the flame and draw off the well products.

It would be desirable to provide a relatively simple wellhead fire extinguisher apparatus that could be lowered in place over an oil well fire and which is adapted to be remotely and automatically operable to cool the fire to separate the ignition point of the flame from the wellhead, then starve the flame of fuel and bypass the unburned fuel to a vent line.

SUMMARY OF THE INVENTION

In view of the shortcomings of the prior art devices, as well as other disadvantages of the prior art not specifically mentioned above, it should be apparent that there still exists a need in the art for a simple, yet effective, wellhead fire extinguisher and method of extinguishing a well fire. It is, therefore, a primary objective of this invention to fulfill that need by providing a wellhead fire extinguisher that is characterized by a simplicity of design and ease of operation not possible with the prior art devices.

The wellhead fire extinguisher of the invention comprises a portable flame containment housing including a wellhead chamber adapted to rest on the well platform or the ground or surface around the wellhead and an elongated tubular flame chamber connected to and communicating with the upper end of the wellhead chamber. A pneumatically-operated flapper valve is mounted inside the wellhead chamber and is pivotable upwardly to close off the flame chamber from the wellhead chamber. The tubular flame chamber has an angled or inclined outlet to direct the flame, heat, and unburned fuel away from the equipment and personnel in the area around the wellhead.

Both the wellhead chamber and the flame chamber are provided with a plurality of inlets for a coolant and/or a chemical flame retardant which is delivered to the inlets via flexible lines. A fuel vent line is connected to the wellhead chamber and is provided with a pressure relief valve which opens at a predetermined pressure to vent unburned fuel away from the wellhead.

According to the method aspects of the present invention, the portable wellhead fire extinguisher of the invention is suspended from a crane or other lifting device and the flapper valve is pneumatically operated to its fully open position. The flame containment housing is then lowered over the burning fire at the wellhead so that the flame passes up through the wellhead chamber and flame chamber. The housing is held in a position spaced a short distance above the wellhead platform so that the wellhead chamber and flame chamber function in a manner similar to a chimney, that is, in a manner to create an updraft sufficient to draw all the surface fire surrounding the wellhead into the containment housing and thereby make it easier to extinguish any remaining ground fire. The housing is then lowered so that it rests on the well platform or the ground and the flame passes out through the angled flame chamber outlet.

Next, a coolant and/or a flame retardant is admitted to the inlets in the wellhead chamber to cool the flame and cause the point of ignition to move upwardly past the flapper valve and into the flame chamber. If a greater cooling effect is necessary to move the ignition point upwardly, the coolant and/or the flame retardant may be introduced into the flame chamber as well. The flapper valve is then operated to its closed position which separates the flame ignition point from the fuel and increases the pressure in the wellhead chamber. When the pressure increases to a predetermined point, the relief valve in the vent line automatically opens to divert the fuel from the wellhead and flame chambers.

Finally, if the coolant/flame retardant has not already been introduced, it is admitted to the flame chamber to complete extinction of the flame.

With the foregoing and other objectives, advantages, and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 3 is a top plan view of the wellhead fire extinguisher apparatus of the present invention; and FIG. 4 is a cross-sectional view of the apparatus of the invention taken along line 4—4 of FIGS. 2 and 3;

FIG. 5 is a cross-sectional view similar to FIG. 4 illustrating the flame containment housing positioned above the wellhead; and FIG. 6 is a cross-sectional view similar to FIG. 4 illustrating the flame containment housing lowered to the surface surrounding the wellhead.

DETAILED DESCRIPTION OF THE INVENTION

Figure 1:
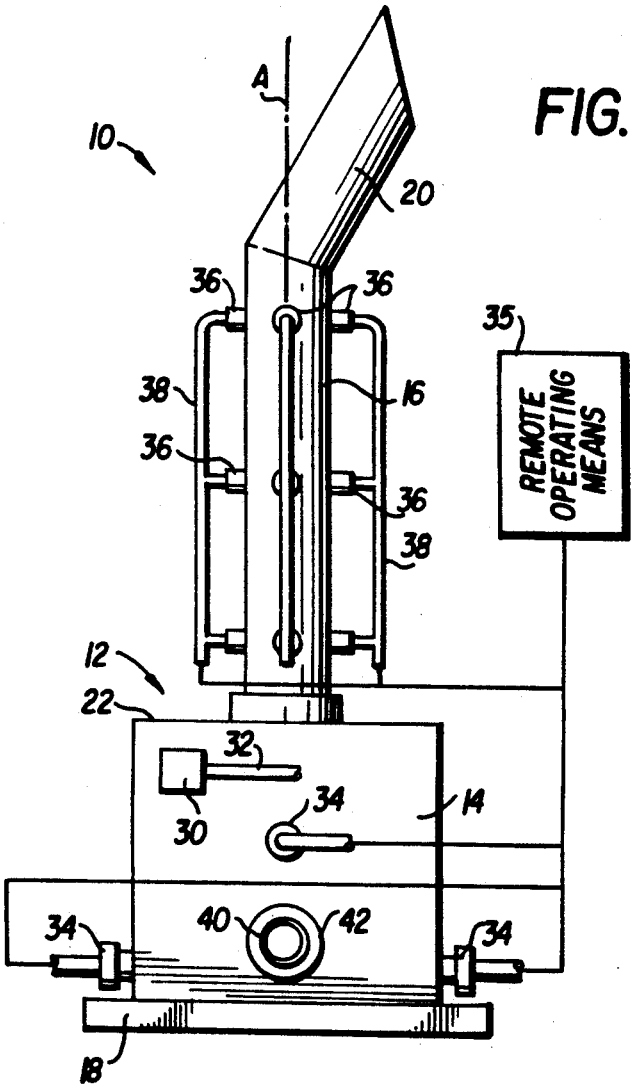
FIG. 1 is a side elevation view of the wellhead fire extinguisher apparatus of the present invention.
Figure 2:
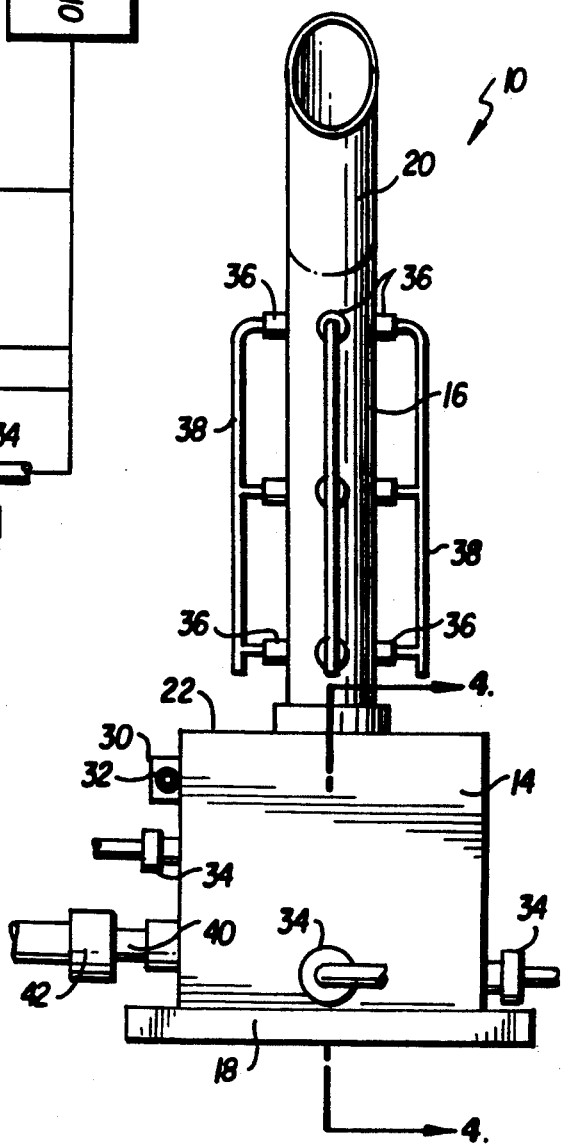
FIG. 2 is a front elevation view of the wellhead fire extinguisher apparatus of the invention.

Referring now in detail to the drawings, there is illustrated in FIGS. 1-3, front elevation, side elevation, and top plan views of the wellhead fire extinguisher apparatus of the invention which is designated generally by reference numeral 10. The apparatus 10 includes a flame containment housing 12 comprising a wellhead chamber 14 and a tubular flame chamber 16. The wellhead chamber 14 is mounted to a heavy support base 18. Preferably, the components of housing 12 are made of welded steel construction. For a typical oil field application, the flame chamber 16 has a diameter of about 20 inches and the wellhead chamber 14 has dimensions of about 4 feet by 6 feet and a height of about 5 feet. Although the wellhead chamber 14 is disclosed herein in the form of a rectangular parallelepiped, it may also have a cylindrical shape with a diameter of 5 to 6 feet or any other suitable shape.

The flame chamber 16 has an angled outlet pipe 20 which is inclined from the longitudinal axis A of chamber 16 by approximately 15°-45°, preferably about 20°-25°, and most preferably about 22°, for a purpose to be described. The lower end of the flame chamber 16 passes through the top wall 22 of the wellhead chamber 14 and is in fluid communication therewith.

Referring to the cross-sectional view of FIG. 4, a flapper valve 24 is pivotable about a shaft 26 to a closed position as shown in FIG. 4 and from the closed position to an open position shown in dashed lines 28 in FIG. 4. A pneumatic actuator 30 mounted to the exterior of wellhead chamber 14 is connected to shaft 26 and is operable to pivot the flapper valve 24 between its open and closed positions. A pneumatic line 32 is connected to the actuator 30 from a source (not shown) of pressurized air.

The wellhead chamber 14 has four (4) inlets 34 for introducing a coolant and/or flame retardant, such as water and carbon dioxide ($CO_2$). Similarly, the flame chamber has a plurality of inlets 36 for the coolant and/or flame retardant which are interconnected by a series of pipes or manifolds 38. Preferably, a remote actuating means 35 is provided for remotely operating the introduction of the coolant and/or flame retardant. The wellhead chamber 14 also has a fuel vent pipe or outlet 40 in which a butterfly-type pressure relief valve 42 is disposed. The pressure relief valve 42 is set to open when a predetermined pressure exists in outlet 40.

Referring now to FIGS. 5 and 6, the apparatus 10 operates in the following manner. If a well fire occurs, the apparatus 10 is suspended from a crane or other heavy lifting apparatus by means of suitable hangers (not shown). Although not illustrated in detail, flexible coolant/fire retardant lines are connected between a valved source and the inlets 34 and manifolds 38 in the wellhead and flame chambers 14, 16, respectively, and between the fuel vent pipe 40 (FIGS. 2 and 3) and a fuel reservoir.

When the apparatus 10 is ready to be lowered over the burning wellhead W, the pneumatic actuator 30 for the flapper valve 24 is operated to move the flapper valve 24 to the open position (FIG. 5). As the apparatus is lowered, the well flame F is directed to flow into the wellhead chamber 14 and flame chamber 16 since the flapper valve 24 is open and the flame ignition point P is located in the wellhead chamber 14. This flow-through of the flame and burning fuel results in no, or only a small, increase in pressure in the wellhead chamber so that the apparatus can continue to be lowered over the wellhead W until it is positioned a short distance above the wellhead platform or the ground S. The flame and fuel flowing through the apparatus 10 functions to create a chimney-like updraft effect in the apparatus so as to draw any flame surrounding the wellhead into the flame containment housing 12.

After the updraft effect is established, the apparatus 10 is lowered to the well platform or ground S (FIG. 6) and coolant/flame retardant is introduced into the wellhead chamber 14 via inlets 34 (as shown by arrows 33) and, if desired, the flame chamber 16 via manifolds 38 and inlets 36 (as shown by arrows 37). This cooling of the flame causes the flame ignition point P to move upwardly into the flame chamber 16. When that happens, the flapper valve is actuated to the closed position (24 in FIG. 6) thus separating the flame from the fuel flowing into wellhead chamber 14. Fuel flow into chamber 14 increases the pressure in the wellhead chamber to the predetermined pressure at which relief valve 42 (FIGS. 2 and 3) opens and the fuel flows out of the chamber 14 through outlet 40 as shown by the arrow 41 in FIG. 3. Since the flame is confined to the flame chamber 16 and the fuel supply is cut off from chamber 16, the flame will eventually extinguish. If desired, coolant/flame retardant can continue to be applied to flame chamber 16 to more rapidly extinguish the flame. When the flame is fully extinguished the wellhead area is cooled with water and/or $CO_2$ to prevent restarting of the fire because of hot components around the wellhead.

As best seen in FIG. 1, the angled portion 20 of the flame chamber 16 advantageously directs the flame and unburned fuel in a direction that prevents unburned hot fuel from falling directly back onto the apparatus 10. Such diversion of the combustible matter also permits personnel to approach the wellhead from a particular direction (from the left as seen in FIG. 1) without being subjected to a shower of burning fuel.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A fire extinguisher for extinguishing a fire at a wellhead comprising:

a flame containment housing comprising a wellhead chamber and a flame chamber, and a flow path between said wellhead chamber and said flame chamber;

a valve disposed in said flame containment housing and being actuable to open and close said flow path, said valve comprising a flapper valve pivotally mounted in said wellhead chamber, said flapper valve being pivotable upwardly to close off the flow path between the wellhead chamber and the flame chamber;

means for actuating said flapper valve to open and close said flow path;

means connected to said flame containment housing for introducing at least one of a coolant and a flame retardant into at least one of said wellhead chamber and said flame chamber; and means connected to the wellhead chamber for venting flow of unburned fuel from the wellhead chamber.

2. The fire extinguisher of claim 1, wherein said flame chamber comprises an elongated tubular chamber having a longitudinal axis and an outlet end inclined from said axis.

3. The fire extinguisher of claim 2, wherein said outlet end is inclined at an angle of about 15° to 45° from said axis.

4. The fire extinguisher of claim 3, wherein said angle is about 20°–25°.

5. The fire extinguisher of claim 1, wherein said means for actuating said flapper valve is pneumatic and remotely operable.

6. The fire extinguisher of claim 1, wherein said flame chamber has an inlet end which extends into said wellhead chamber, said flapper valve being arranged to seat on said inlet end to close off said flow path.

7. The fire extinguisher of claim 1, wherein said flow venting means comprises a vent line connected to the wellhead chamber and a pressure relief valve disposed in said vent line and set to open at a predetermined pressure.

8. The fire extinguisher of claim 1, wherein said flame containment housing is portable.

9. The fire extinguisher of claim 1, wherein said coolant is water and said flame retardant is carbon dioxide.

10. A fire extinguisher for extinguishing a fire at a wellhead comprising:

a flame containment housing comprising a wellhead chamber and a flame chamber, and a flow path between said wellhead chamber and said flame chamber;

a valve disposed in said flame containment housing and being actuable to open and close said flow path;

means for actuating said valve to open and close said flow path;

means connected to said flame containment housing for introducing at least one of a coolant and a flame retardant into at least one of said wellhead chamber and said flame chamber, said introducing means comprising a plurality of inlets in said wellhead chamber and a plurality of inlets in said flame chamber, said introducing means including means for remotely operating the introducing means to admit at least one of the coolant and the flame retardant; and means connected to the wellhead chamber for venting flow of unburned fuel from the wellhead chamber.

11. The fire extinguisher of claim 10, including at least four inlets in said wellhead chamber and at least twelve inlets in said flame chamber.

12. The fire extinguisher of claim 10, wherein said coolant is water and said flame retardant is carbon dioxide.

13. A method of extinguishing a well fire having a flame with an ignition point, said well fire being fueled by a flow of a fuel product of a wellhead, said wellhead having a surface adjacent thereto, said method comprising the steps of:

providing a flame containment housing comprising a wellhead chamber and a flame chamber having a longitudinal axis and including a flow path between said chambers having open and closed positions;

lowering the flame containment housing over the well fire with the flow path between said chambers open;

holding the flame containment housing spaced above the surface adjacent the wellhead to create an updraft through said housing;

further lowering the flame containment housing around the wellhead to the surface adjacent the wellhead;

introducing at least one of a coolant and a flame retardant into the flame containment housing to raise the ignition point of the flame into the flame chamber;

closing the flow path between the wellhead chamber and the flame chamber to isolate the well fire in the flame chamber; and venting the flow of the fuel product from the wellhead from the wellhead chamber.

14. The method of claim 13, wherein the closing step comprises remotely actuating a valve to open and close the flow path between the wellhead chamber and the flame chamber.

15. The method of claim 13, wherein said introducing step includes the step of introducing at least one of the coolant and the flame retardant into the wellhead chamber.

16. The method of claim 15, wherein said introducing step further includes the step of introducing at least one of the coolant and the flame retardant into the flame chamber.

17. The method of claim 13, further including the step of directing the flame of the well fire at an angle to the longitudinal axis of the flame chamber.

18. The method of claim 13, further including the step of directing the flame of the well fire at an angle of about 15°–45° to the longitudinal axis of the flame chamber.

19. The method of claim 13, further including the step of directing the flame of the well wire at an angle of about 20°–25° to the longitudinal axis of the flame chamber.

20. The method of claim 13, wherein the flow of the fuel product into the wellhead chamber creates a pressure, said venting step further including the step of opening a vent line from the wellhead chamber when the pressure in the wellhead chamber exceeds a predetermined pressure.

* * * * *